United States Patent [19]

Berchem

[11] Patent Number: 4,488,608

[45] Date of Patent: Dec. 18, 1984

[54] ROTARY STONE-CUTTING HEAD WITH HARDENED TEETH INSERTS

[75] Inventor: Rütger Berchem, Gelsenkirchen, Fed. Rep. of Germany

[73] Assignee: Berchem & Schaberg GmbH, Gelsenkirchen, Fed. Rep. of Germany

[21] Appl. No.: 413,233

[22] Filed: Aug. 31, 1982

[30] Foreign Application Priority Data

Sep. 11, 1981 [DE] Fed. Rep. of Germany ..... 3136077

[51] Int. Cl.[3] ..... E21B 10/52

[52] U.S. Cl. ..... 175/374; 175/410; 299/89

[58] Field of Search ..... 299/89, 88, 79; 175/409, 410, 411, 374, 375, 379; 51/309, 308

[56] References Cited

U.S. PATENT DOCUMENTS

| | | | |
|---|---|---|---|
| 2,145,756 | 1/1939 | Ervin | 51/309 |
| 2,171,081 | 8/1939 | Ervin | 51/309 |
| 2,732,198 | 1/1956 | Joy | 299/79 |
| 3,356,418 | 12/1967 | Healey et al. | 175/410 |
| 3,958,832 | 5/1976 | Sigott et al. | 299/89 |
| 3,984,910 | 10/1976 | Helton et al. | 175/411 |
| 4,342,486 | 8/1982 | O'Neill | 299/86 |

*Primary Examiner*—James A. Leppink
*Assistant Examiner*—Mark J. DelSignore
*Attorney, Agent, or Firm*—Karl F. Ross; Herbert Dubno

[57] ABSTRACT

A rotary stone-cutting head has a body generally centered on and adapted to be rotated in a predetermined direction about a body axis. An array of cutter supports on the body are angularly spaced about the axis. Respective outer cutter teeth carried on some of the supports have relative to the axis respective outer cutting edges generally radially equispaced from the axis and defining on rotation of the body about the axis an outer orbit centered on the axis. Respective inner cutting teeth are carried on the rest of the supports, alternating with the outer cutting teeth. Respective hardened-metal inserts mounted on the inner teeth have relative to the axis respective outer ends generally radially equispaced from the axis and defining on rotation of the body about the axis an inner orbit radially within and coaxial with the outer orbit. These inserts are substantially harder than the teeth. At the start of use of the head, the hardened inserts will not engage the surface being cut before the outer teeth. In this manner the hard inserts will only contact the face once the cutting operation is started and the surface being cut is fairly regular.

6 Claims, 3 Drawing Figures

ROTARY STONE-CUTTING HEAD WITH HARDENED TEETH INSERTS

FIELD OF THE INVENTION

The present invention relates to a rotary stone-cutting head. More particularly this invention concerns such a cutter which is used to drill or to remove or recover ore, coal, or the like.

BACKGROUND OF THE INVENTION

A rotary stone-cutting head normally has a body generally centered on and adapted to be rotated in a predetermined direction about a normally upright axis. One axial face, normally the bottom one, of this body has a plurality of teeth having cutting edges that are directed angularly generally forwardly in a predetermined direction of rotation of the body about its axis. A suction arrangement opens at the normally open center of the body so that chips and so on freed by the teeth are carried off, normally along with water or another liquid fed to the tool to lubricate and cool it as well as to serve as a vehicle for the freed chips.

These cutting edges therefore do virtually all of the removal work. Hence they get quite hot and are subjected to enormous wear. Thus it is standard practice to form these teeth of separate hardened-steel elements that are secured to the face of the drilling or cutting head. To this end appropriately edged small hardened-steel plates are brazed or soldered to appropriate seats on the front or lower body face.

German utility model No. 7,828,385, German patent publication No. 2,841,523, and U.S. Pat. No. 2,984,028 describe such an arrangement wherein the teeth supports are radially outwardly projecting and tapered pins. The teeth have tapered recesses that fit snugly over these pins, and a wedge or the like passing through appropriate transverse holes in the teeth and supports hold these teeth in place on the respective supports.

In such an arrangement the teeth are not subject to even wear. The large head inherently rotates relatively slowly, so that a hard node in the rock can be uncovered by one tooth and then engaged solidly by the next one. Similarly as the head moves into contact with the rock, which inherently has some voids and soft spots, it subjects some of the teeth to much greater wear than others. Thus it is fairly common for the hardened edge of a tooth to be broken by suddenly engaging a hard spot, as such hardened edge has less give than the softer cast iron of the teeth.

In my copending patent application No. 389,970 filed 18 June 1982 I describe a rotary stone-cutting head of the standard type, that is having a body generally centered on and adapted to be rotated in a predetermined direction about an axis. According to this earlier invention an array of cutter supports on the body directed at least partially in the direction carry respective cutter teeth each having relative to the axis an outer cutting edge and relative to the direction a generally angularly forwardly directed face adjacent the edge and formed with an array of holding recesses. The teeth are at least at the edges of hardened metal. Means removably secures the teeth to the respective supports and respective hardened-metal breaking pins have shanks fitted to the recesses and points directed angularly forwardly in the direction. At least some of the points lie angularly ahead in the direction of the respective cutting edge.

These points have a crushing effect that greatly augments the effectiveness of the cutter head. Preliminarily engaging the stone surfaces with these crushing or breaking points makes for much more efficient overall material removal in conjunction with subsequent cutting or peeling of the surface. In addition these pins strike hard nodes and the like before the cutting edges to reduce wear on these parts.

Such an arrangement has shown to give superior results. Nonetheless the hardened-metal parts of the teeth do get broken rather frequently. The teeth are quite expensive to manufacture, as each must be bored out for a group of the breaking pins.

OBJECTS OF THE INVENTION

It is therefore an object of the present invention to provide an improved stone-cutting head.

Another object is the provision of such a stone-cutting head which overcomes the above-given disadvantages.

Yet another object is to providc a stone-cutting head having reinforced teeth with a longer service life than has been hitherto considered possible.

SUMMARY OF THE INVENTION

These objects are attained according to the instant invention in a rotary stone-cutting head having a body generally centered on and adapted to be rotated in a predetermined direction about a body axis. An array of cutter supports on the body are angularly spaced about the axis. Respective outer cutter teeth carried on some of the supports have relative to the axis respective outer cutting edges generally radially equispaced from the axis and defining on rotation of the body about the axis an outer orbit centered on the axis. Respective inner cutting teeth are carried on the rest of the supports, alternating, according to this invention, with the outer cutting teeth. Respective hardened-metal inserts mounted on the inner teeth have relative to the axis respective outer ends generally radially equispaced from the axis and defining on rotation of the body about the axis an inner orbit radially within and coaxial with the outer orbit. These inserts are substantially harder than the teeth.

Thus with the system of this invention at least at the start the hardened inserts will not engage the surface being cut before the outer teeth. In this manner the hard inserts will only contact the face once the cutting operation is started and the surface being cut is fairly regular. Since it has been found that most damage to the hardened teeth takes place at the start of a cutting operation, the construction according to this invention largely avoids using these reinforced teeth until after the cut has been started.

According to this invention the teeth are radially outwardly tapered and centered on respective teeth axes extending generally radially of the body axis. The inserts are rods lying inside the respective inner teeth and extending along the respective teeth axes.

In accordance with another feature of the invention at least before use of the head the inner teeth are radially shorter than the outer teeth. It is also possible for the teeth to be identical and the supports of the outer teeth to be spaced radially further from the body axis than the supports of the inner teeth.

The inner teeth, according to another inventive feature, are formed with respective radially outwardly open blind bores of a predetermined radial depth. The inserts are rods tightly fitted in the respective bores and of a radial length shorter than the bore depth. Thus the rods are recessed radially inward in the respective bores. Such construction is extremely simple and cheap.

The teeth according to the invention are formed of an alloy having the following composition by weight:

| | |
|---|---|
| 0.7%–1.0% | manganese, |
| 0.7%–2.2% | chromium, |
| 0.3%–0.6% | molybdenum, |
| 0.5%–2.2% | nickel, |
| 0%–0.45 | carbon, and |
| balance | iron. |

This alloy is hardened more than 6%, preferably 8%, to have a strength of between 140kp/mm$^2$ and 200kp/mm$^2$, preferably about 180kp/mm$^2$.

The supports of the system of this invention are pins centered on respective axes extending radially of the body axis and the teeth are formed with radially inwardly open recesses complementary to and fitting snugly over the respective supports. These supports and the teeth are formed with aligned throughgoing bores extending transverse to the respective teeth axes. The head has respective retaining wedges extending through the respective aligned holes of each tooth. Such construction makes it very easy to remove and replace teeth if necessary.

DESCRIPTION OF THE DRAWING

The above and other features and advantages will become more readily apparent from the following, reference being made to the accompanying drawing in which.

SPECIFIC DESCRIPTION

Figure 1:
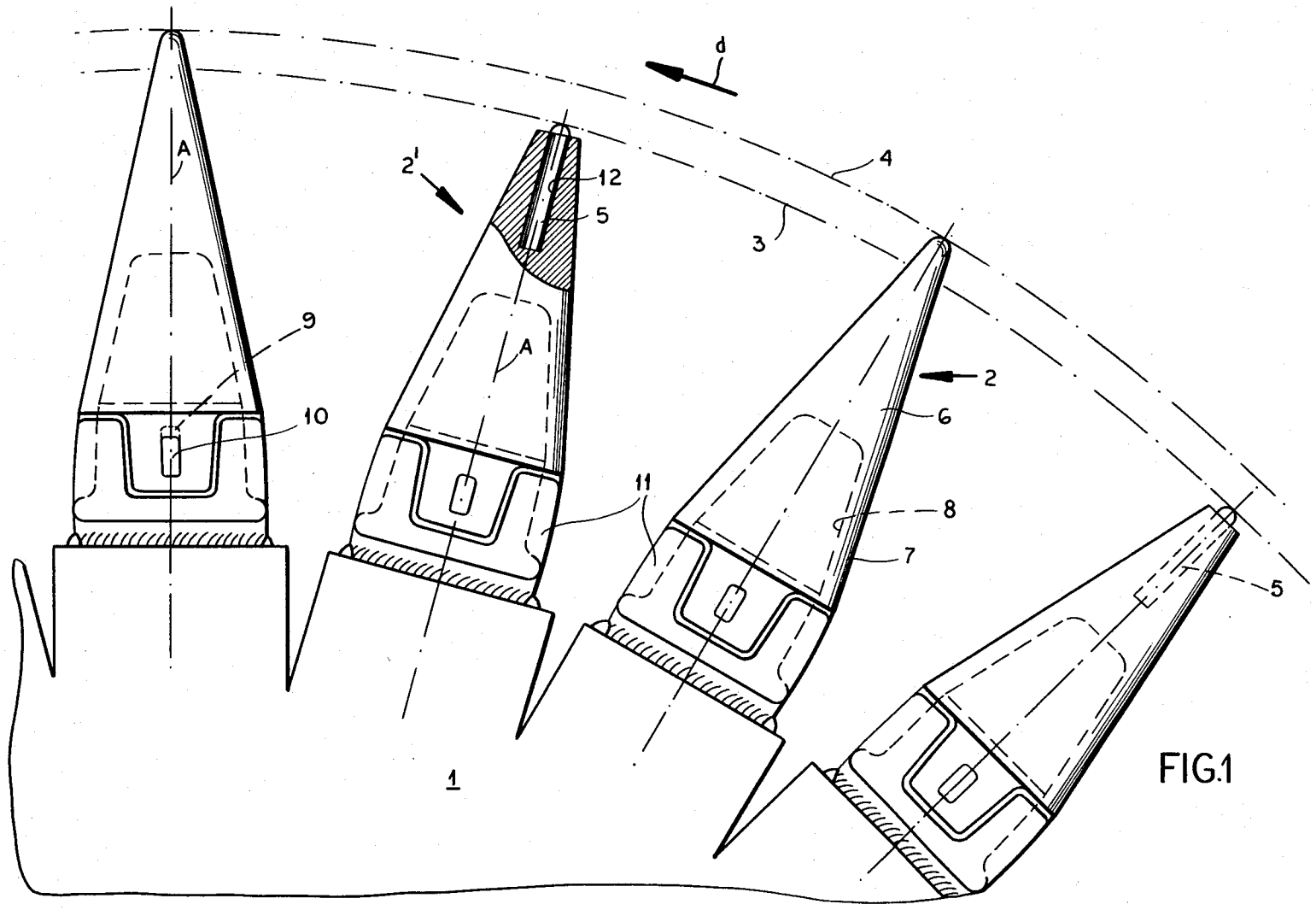
FIG. 1 is an axial end view partly in section through a cutting head according to this invention.

As seen in FIG. 1, a cutter head centered on and rotatable about an axis perpendicular to the plane of the view has a body 1 that is normally rotated in the direction indicated by arrow D about the body axis while it is pushed axially against stone to be cut away. This body 1 carries an annular succession of identical cutting-tooth holders 11 carrying respective cutter teeth 2 and 2′ that alternate with each other. The holders 11 and the respective teeth 2 and 2′ have respective axes or centerlines A which extend radially of the unillustrated body axis. Rock, ore, and the like can be broken off by these teeth 2 and 2′ to move radially inward to the open center of the body 1. Thence the broken-off material is normally aspirated with the water or other liquid that cools and lubricates the cutter.

The teeth 2 and 2′ are fairly similar, both having a conical body 6 and a hollow base or skirt 7 formed with a recess 8 snugly fitting over the respective adapter or support 11 of the body 1. In addition the skirt 7 and support 11 are formed with aligned bores 9 transverse to the respective axis A and receiving respective wedges or holding pins 10 that secure the teeth 2 and 2′ in place on the identical supports 11.

According to this invention the teeth 2′ are slightly shorter than the teeth 2, so that they have an inner orbit 3 concentric with but lying within the orbit 4 of the outer teeth 2. In addition each inner tooth 2′ is formed on the respective centerline A with a radially outwardly open bore 12 tightly receiving a hardened-metal rod or pin 5 whose outer end 5′ projects slightly radially from the respective tooth 2′ and forms the orbit 3.

Each of the teeth 2 and 2′ is a massive casting of Mn-Cr-Mo-Ni steel having the following composition by weight:

| | |
|---|---|
| 0.7%–1.0% | nanganese, |
| 0.7%–2.2% | :nromium, |
| 0.3%–0.6% | nolybdenum, |
| 0.5%–2.2% | ıickel, |
| 0%–0.45 | :arbon, and |
| balance | ıron. |

This alloy is stretch-hardened more than 6%, preferably at least 8%, to have a strength of between 140kp/mm$^2$ and 200kp/mm$^2$, preferably 180kp/mm$^2$.

The pins 5, which are of tungsten carbide or a similarly hard metal, are much harder but much more brittle than the rest of the respective teeth 2 and 2′. When the head is pushed into engagement with the face to be cut, the teeth 2 take the brunt of the first few cuts until the rock is smoothed out and has assumed the shape of the orbit 4. Thereafter the teeth 2′ will participate in the cutting operation. The teeth 2′ greatly speed up the stone-removal rate, since the softer teeth 2 cut relatively slowly. The irregularities of the rock surface and the normally limited radial bouncing of the head on it ensure that the teeth 2′ do contact the surface, even though the cutting edges of the teeth 2 lie radially outside those of the teeth 2′.

Figure 2:
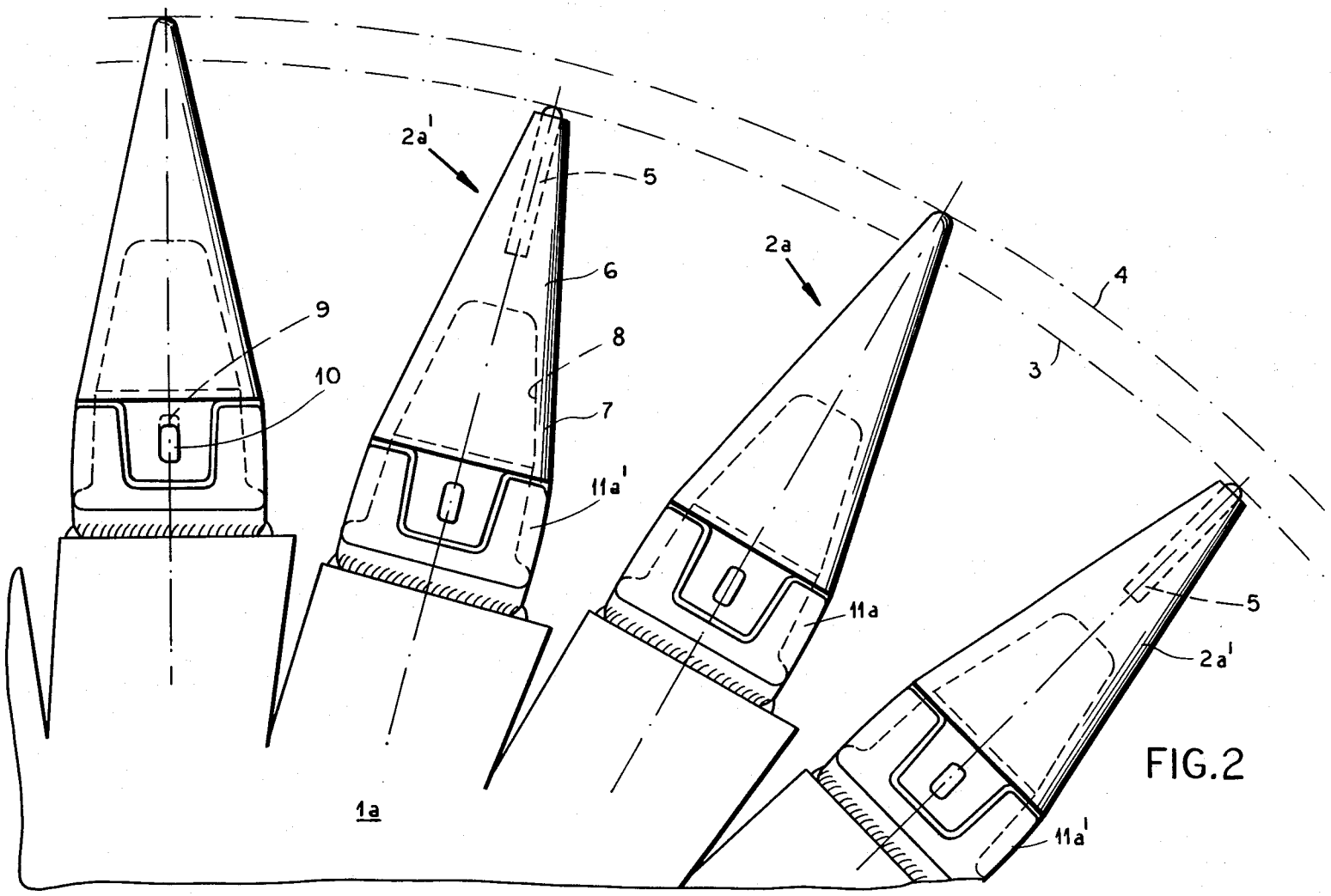
FIGS. 2 and 3 are views similar to FIG. 1 showing further heads according to the invention.

FIG. 2 shows an arrangement identical to that of FIG. 1, except that the outer teeth 2*a* are of the same length as the inner teeth 2*a*′, and the body 1*a* has supports 11*a* and 11*a*′ that are radially staggered. The supports 11*a*′ lie radially inside the supports 11*a* so that the tips of the rods 5 lie on the inner orbit 3. The advantage of such a system is that the same mold can be used for making the teeth 2*a* and the teeth 2*a*′, the latter needing boring-out and fitting with the insert rods 5.

Figure 3:
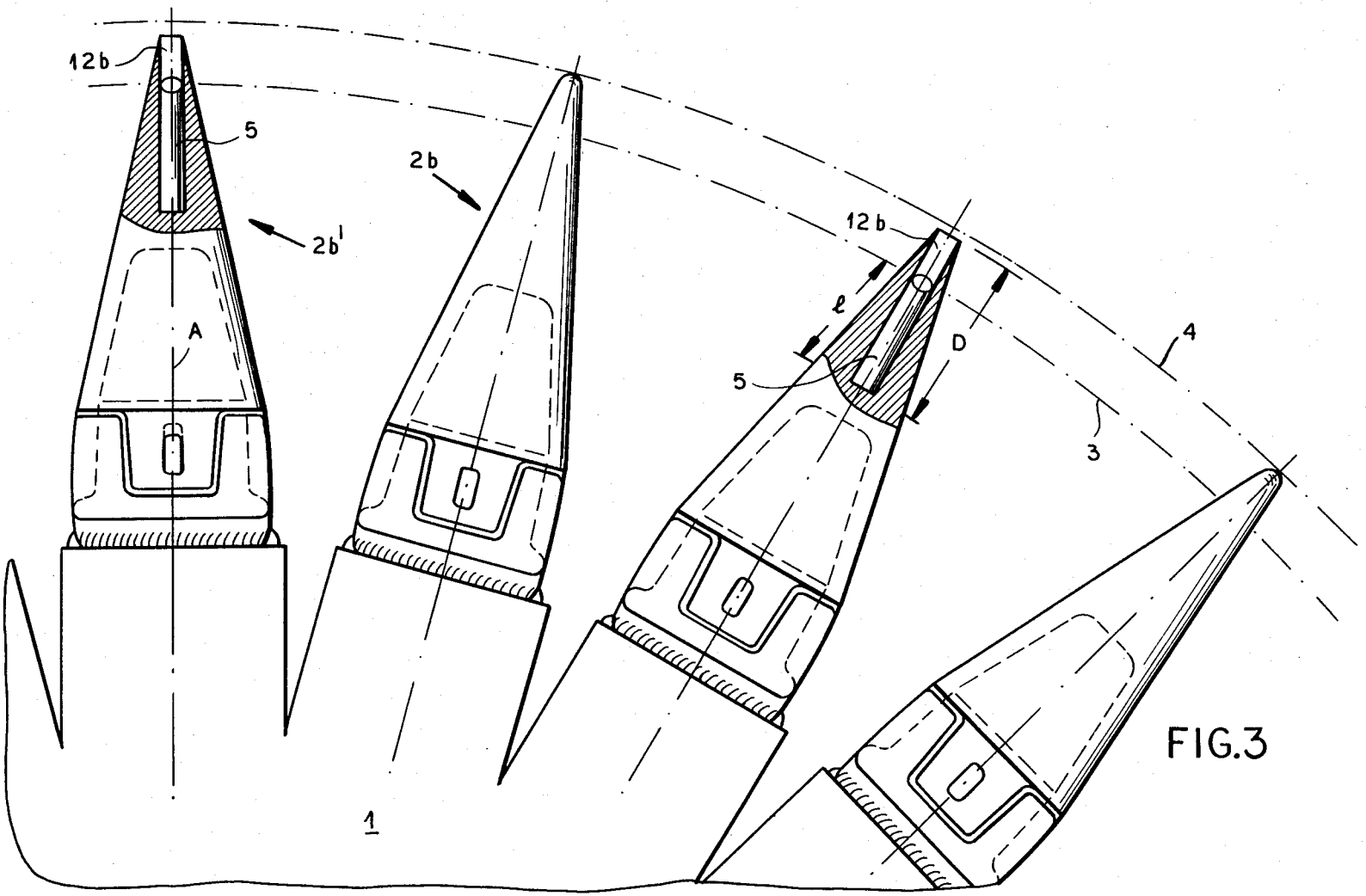

In FIG. 3 the holder 1 is identical to that of FIG. 1 and the teeth 2*b* and 2*b*′ are of identical construction, except that the teeth 2*b*′ are formed on their axes A with radially outwardly open blind bores 12*b* receiving the pins 5. The bores 12*b* have a depth D which is longer than the length 1 of the tungsten-carbide pin 5 by a distance equal to the radial distance between the orbits 3 and 4. The outer ends of the teeth 2*b*′ wear off quite rapidly, leaving the system substantially identical to that of FIG. 1. The advantage of this arrangement is similar to that of FIG. 2, that the teeth can be produced at low cost.

I claim:

1. A rotary stone-cutting head comprising:

a body generally centered on and adapted to be rotated in a predetermined direction about a body axis;

an array of cutter supports on the body angularly spaced about the body axis;

respective outer cutter teeth carried on some of the supports and having relative to the body axis respective outer cutting edges generally radially equispaced from the body axis and defining on rotation of the body about the body axis an outer orbit centered on the body axis;

respective inner cutting teeth carried on the rest of the supports and alternating with the outer cutting teeth, the inner and outer teeth being radially outwardly tapered and centered on respective teeth axes extending generally radially of the body axis; and respective hardened-metal insert rods mounted only on the inner teeth centered on the respective teeth axes and having relative to the body axis respective outer ends generally radially equispaced from the body axis and defining on rotation of the body about the body axis and inner orbit radially within and coaxial with the outer orbit, the insert rods being substantially harder than the cutting edges of the outer teeth, the outer teeth being free of such rods.

2. The stone-cutting head defined in claim 1 wherein at least before use of the head the inner teeth are radially shorter than the outer teeth.

3. The stone-cutting head defined in claim 1 wherein the inner teeth are formed with respective radially outwardly open blind bores of a predetermined radial depth, the inserts being rods tightly fitted in the respective bores and of a radial length shorter than the bore depth, whereby the rods are recessed radially inward in the respective bores.

4. The stone-cutting head defined in claim 1 wherein the teeth are formed of an alloy having the following composition by weight:

| | |
|---|---|
| 0.7%–1.0% | manganese, |
| 0.7%–2.2% | chromium, |
| 0.3%–0.6% | molybdenum, |
| 0.5%–2.2% | nickel, |
| 0%–0.45 | carbon, and |
| balance | iron, |

the alloy being hardened more than 6% to have a strength of between 140kp/mm$^2$ and 200kp/mm$^2$.

5. The stone-cutting head defined in claim 1 wherein the supports are pins centered on respective axes extending radially of the body axis and the teeth are formed with radially inwardly open recesses complementary to and fitting snugly over the respective supports.

6. The stone-cutting head defined in claim 5 wherein the supports and teeth are formed with aligned throughgoing bores extending transverse to the respective teeth axes, the head further comprising respective retaining wedges extending through the respective aligned holes of each tooth.

* * * * *